US006111239A

United States Patent [19]

Park

[11] Patent Number: 6,111,239

[45] Date of Patent: Aug. 29, 2000

[54] APPARATUS AND METHOD OF HEATING A CUP IN A MICROWAVE OVEN

[75] Inventor: Won Kyung Park, Kyungman, Rep. of Korea

[73] Assignee: LG Electronics Inc., Seoul, Rep. of Korea

[21] Appl. No.: 09/189,811

[22] Filed: Nov. 12, 1998

[30] Foreign Application Priority Data

Nov. 14, 1997 [KR] Rep. of Korea ..... 97-60144

[51] Int. Cl.[7] ..... H05B 6/68

[52] U.S. Cl. ..... 219/710; 219/711; 219/702; 702/130; 99/325

[58] Field of Search ..... 219/710, 712, 219/702, 707, 708, 711; 702/130; 99/325; 374/149

[56] References Cited

U.S. PATENT DOCUMENTS

| | | | |
|---|---|---|---|
| 4,131,779 | 12/1978 | Tatsukawa et al. | 219/710 |
| 4,230,731 | 10/1980 | Tyler | 426/233 |
| 4,467,163 | 8/1984 | Pauley et al. | 219/712 |
| 4,467,164 | 8/1984 | Nakata et al. | 219/710 |
| 4,517,431 | 5/1985 | Ueda | 219/719 |
| 4,970,359 | 11/1990 | Oh | 219/710 |
| 5,382,775 | 1/1995 | Lee | 219/702 |
| 5,389,764 | 2/1995 | Nishii et al. | 219/506 |
| 5,739,505 | 4/1998 | Hasegawa et al. | 219/494 |
| 5,893,051 | 4/1999 | Tomohiro | 702/130 |

*Primary Examiner*—Philip H. Leung

[57] ABSTRACT

The present invention relates to a microwave oven, and more particularly to an apparatus and a method for heating food or the like in a container using a microwave oven by judging a quantity of food in the container based on a change in initial temperature and compensating for variations between a detected and a cooking temperature. The method of heating the cup according to the present invention comprises the steps of detecting variation degree of the temperature for initial uniform time period, judging the quantity of the subject matter on the basis of the detected variation degree of the temperature, estimating the raised temperature on the basis of quantity of the subject matter, comparing the estimated temperature with the temperature detected by sensor to determine the higher temperature as a current temperature, and executing the cooking mode until the current temperature is raised to the set cooking temperature.

6 Claims, 5 Drawing Sheets

APPARATUS AND METHOD OF HEATING A CUP IN A MICROWAVE OVEN

BACKGROUND OF THE INVENTION

The present invention relates to a microwave oven, and more particularly, to an apparatus and a method for heating a container containing food or the like in a microwave oven by judging a quantity of food in the container on the basis of a change of an initial temperature of the food and compensating for variations between a detected temperature and a cooking temperature.

In a general method for heating a container in the microwave oven, the container is heated in a heating mode until the temperature detected by an infrared sensor is raised to the prescribed temperature.

FIG. 1 is a block diagram showing the structure of the conventional microwave oven.

In the conventional microwave oven, as shown in FIG. 1, the cooking chamber 1 has an opening 4 formed at the upper portion of its side wall. An infrared sensor 5 for sensing the temperature of the container 7 is set therein through the opening 4. Further, the microwave oven includes a heating unit 3 generating microwaves on the basis of the temperature detected by the infrared sensor 5 and a judging unit 6 controlling the operation of the object.

In the lower portion of the cooking chamber 1, a motor 8 is provided to drive a turntable 2 according to a control signal for the judging unit 6. The turntable 2 is rotatably mounted within the cooking chamber 1 on the upper portion of the shaft of the motor 8. On the turntable 2, the container 7 containing the food to be cooked is located.

The judging unit 6 controls operation of the heating unit 3 and the motor 8 after a heat starting key is actuated. The judging unit 6 includes the structure indicated in FIG. 2. This structure is described in detail as follows. The judging unit 6 comprises a key input unit 6*a* for setting a cooking temperature corresponding to the selected food or for inputting a starting signal; a set temperature storing unit 6*b* for storing the set cooking temperature; a current temperature storing unit 6*c* for temporarily storing the current temperature detected by the infrared sensor 5; a display unit 6*d* including a liquid crystal display to indicate the set and current temperature; and an output controlling unit 6*e* for comparing the set temperature with the current temperature to thereby control the output.

With the signal detected by the sensor 5, the current temperature is judged by the judging unit 6. When the detected current temperature is lower than the set temperature, the judging unit 6 operates the heating unit 3 until the current temperature reaches the set temperature for completion of cooking.

The cup 7 within the cooking chamber 1 is heated by the microwaves generated by the heating unit 3. When starting the heating operation, the turntable 2 is rotated to evenly apply the microwaves to the container 7.

Hereinafter, the operation of the conventional microwave oven is described in detail accompanying the drawings.

FIG. 3 is a flow chart illustrating a cooking operation of a conventional microwave oven.

The container 7 is first put on the turntable 2 in the cooking chamber 1, the key input unit 6*a* is operated to set the appropriate cooking temperature, and the cooking start key is actuated. The set cooking temperature is memorized in the set temperature storing unit 6*b*. When the cooking starting key is activated, the heating unit 3 is driven according to a controlling signal from the output controlling unit 6*e*. As a result, microwaves are generated by the heating unit 3 so that the container 7 with food therein is heated. Because of the heating operation of the heating unit 3, the temperature of the container 7 gradually increases.

On the other hand, the temperature of the container 7 is detected by the infrared sensor 5 through the opening 4.

The output controlling unit 6*e* reads the temperature stored in the current temperature storing unit 6*c* and the cooking temperature stored in the set temperature storing unit and compares them (step 110). When the detected current temperature is lower than the cooking temperature, the heating unit 3 is continuously driven by the output controlling unit 6*e* to heat the container 7. When the current temperature is raised to at least the set cooking temperature, the output controlling unit 6*e* stops operation of the heating unit 3 for completion of cooking (step 120).

The container 7 located in the cooking chamber 1 may include a cup containing a food such as water or milk. Since the container is heated by the microwaves generated by the heating unit 3, the practical temperature of the food 9 in the container 7 can be higher than the cooking temperature when the current temperature is detected by the infrared sensor 5. Particularly, when a small amount of food 9 is in the container, the difference between the actual temperature of the food 9 and the set cooking temperature is larger.

This difference is caused by heat conduction. That is, the heat of the food 9 is transmitted to the container 7 so that the food 9 is at a higher temperature than that of the container. Further, the temperature deviation between the various parts of the container 7 and the food causes a temperature difference between the container 7 and the food according to quantity of the food present.

For example, when the container is heated to a set cooking temperature of 50° C.,

- if the amount of food in the container is 100 ml, its temperature is 73° C.;
- if the amount of food in the container is 150 ml, its temperature is 69° C.;
- if the amount of food in the container is 200 ml, its temperature is 63° C.;
- if the amount of food in the container is 250 ml, its temperature is 51° C.;
- if the amount of food in the container is 300 ml, its temperature is 51° C.; and
- if the amount of food in the container is 350 ml, its temperature is 43° C.

In the conventional method of heating a container in the microwave oven using the infrared sensor 5, a small quantity of food is blocked from the sensing region of the infrared sensor 5 by the sides of the container since the infrared sensor 5 is mounted at the upper portion of the side wall (as shown in FIG. 4).

In the conventional microwave oven, therefore, the actual food temperature is in the container has the great difference temperature from the set cooking temperature. As a result, there is some inconvenience for the user.

SUMMARY OF THE INVENTION

An object of the present invention is to provide an apparatus and a method for heating a cup or container in a microwave oven in which a difference between the temperature of the food within the container and the set cooking temperature can be minimized.

In order to achieve this object, the method according to the present invention comprises detecting a change in temperature for an initial uniform time period, judging the quantity of food on the basis of the detected change in the temperature, estimating the raised temperature on the basis of quantity of food, comparing the estimated temperature with the temperature detected by sensor to select the higher temperature of the two as a current temperature, and continuing cooking until the current temperature is raised to the set cooking temperature.

Further, an apparatus according to the present invention comprises means for storing a temperature gradient dependent upon the change in temperature detected by the sensor for the initial uniform time period; a first storing means for storing a temperature detected by the sensor; a second storing means for storing an estimated temperature, the estimated temperature being in inverse proportion to the temperature gradient stored the gradient storing means and in proportion to the current time; and means for comparing temperatures stored in the first and second storing means to heat the container at the higher temperature.

In the apparatus and the method of heating the cup according to the present invention, variations in the detected temperature of the food may be compensated, because the infrared sensor cannot accurately detect the temperature of small quantities of food subject matter in the cup.

For large variations of the initial temperature, (that is, for large quantities of the food), the change in temperature for the food is directly detected by the infrared sensor so that the estimated temperature is raised with a certain low temperature gradient.

For small variations of the initial temperature, (that is, for small quantities of food), the change in temperature for the food cannot be measured by the infrared sensor so that the estimated temperature is raised with a prescribed high temperature gradient.

Thus, the detected temperature is compensated according to the quantity of the food in the container. The temperature deviation for quantity of the food can be minimized by comparing the compensated current temperature with the set cooking temperature.

DETAILED DESCRIPTION OF THE INVENTION

Hereinafter, the present invention is described in detail accompanying the drawings.

Figure 1:
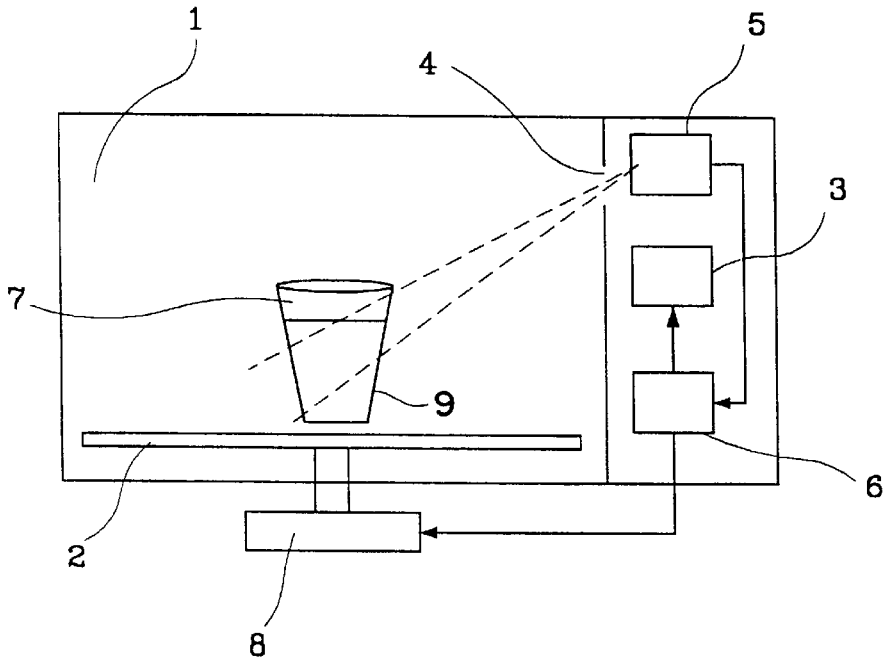
FIG. 1 CONVENTIONAL ART
FIG. 1 is a view showing the conventional microwave oven.
Figure 2:
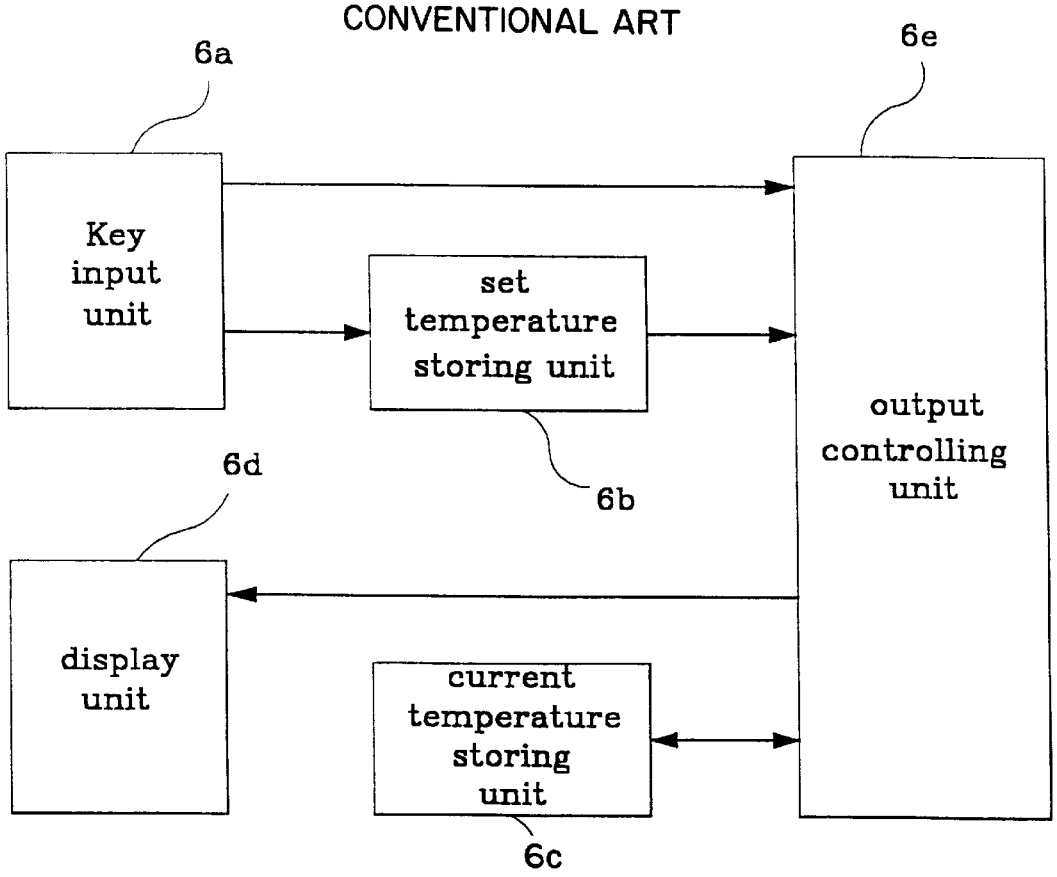
FIG. 2 CONVENTIONAL ART
FIG. 2 is a block diagram showing the judging unit of FIG. 1.
Figure 3:
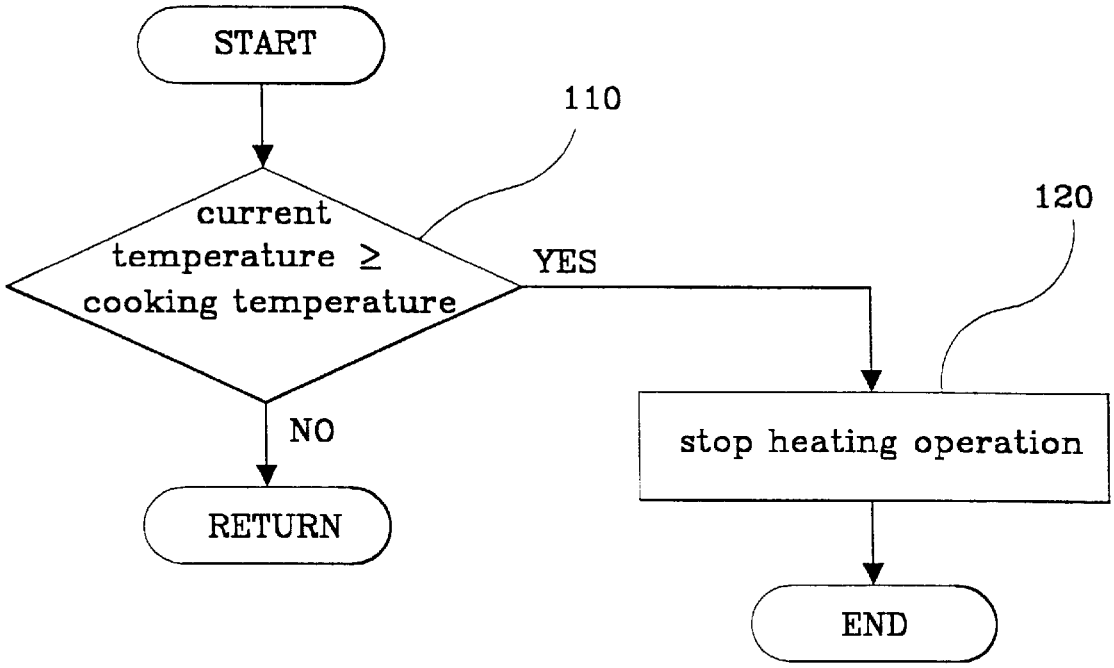
FIG. 3 CONVENTIONAL ART
FIG. 3 is a flow chart showing a method of heating a cup of food in the conventional microwave oven.
Figure 5:
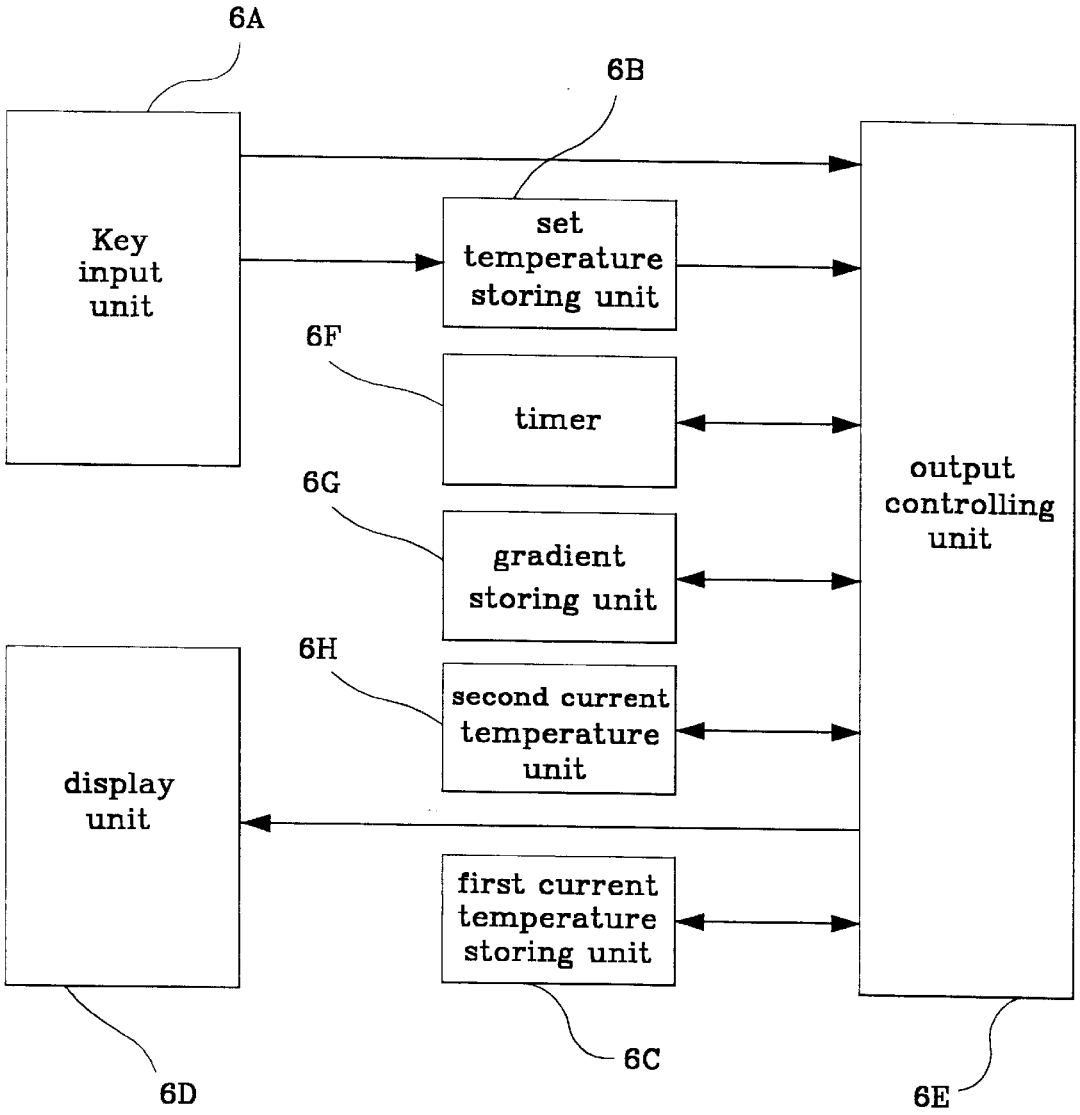
FIG. 5 is a block diagram showing the judging unit for temperature compensation control according to the present invention.
Figure 6:
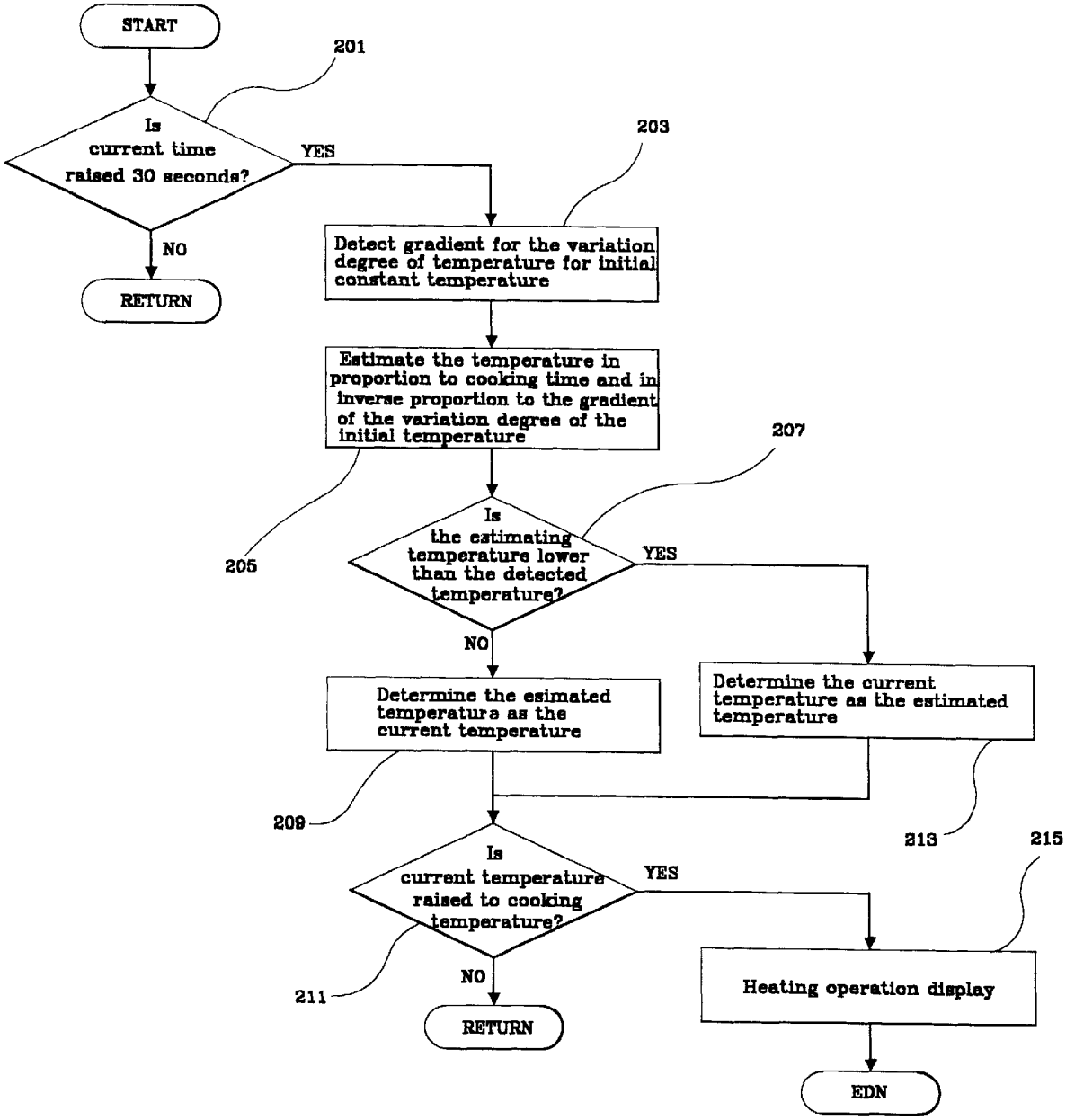
FIG. 6 is a flow chart showing the method of heating a container of food according to the present invention.

The entire structure of the microwave oven is illustrated in FIG. 1 and the judging unit is illustrated in FIG. 5.

The microwave oven comprises a rotatable turntable 2 provided at the center of the cooking chamber 1, a heating unit 3 for generating microwaves to heat a container 7 containing food of the like, a temperature sensor 5 of thermopile type for detecting the temperature of the container 7 in the cooking chamber 1 in on-contact manner (through the opening 4 formed at the upper portion of the side wall in the cooking chamber 1), and the judging unit 6 for controlling operation of the circuit unit including the heating unit 3 according to the detected temperature.

The judging unit 6 comprises key input unit 6*a* by which the cooking temperature of the selected food is set to an appropriate temperature and by which the heating operation is started (with a "start" key). Set temperature storing unit 6B stores the set cooking temperature. First current temperature storing unit 6C stores the current temperature as detected by the sensor 5. Display unit 6D displays the set cooking temperature, the current temperature, and the time. Further, the judging unit 6 includes output controlling unit 6E for controlling the output by comparing the current temperature with the set cooking temperature, a timer 6F for measuring the cooking time, a first storing unit 6G for storing the gradient of the change in the initial temperature of container 7, and a second current temperature storing unit 6H for estimating and storing the current estimated temperature of the food 9 in the container 7.

In the above structure, when a user operates the key input unit 6 to heat the container 7, the heating unit 3 heats the container 7 for the initial set time period under the control of the output controlling unit 6E. When the container 7 is heated for this set time period, the change in temperature over time is detected. At this time, the detected gradient (or rate of change) of the temperature change is stored in the storing unit 6H. The output controlling unit 6E judges the quantity of the food in the container 7 by this gradient and estimates the raised temperature according to this quantity.

At this time, an initial time period (which is a part of the total heating time) is selected. If the change in the detected temperature is large during the initial time period, this means that the change of the temperature is directly detected by the infrared sensor 5, as shown in FIG. 1. In this case, the food or the like in the container 7 is more than an appropriate quantity. That is, the food temperature is rapidly raised at the initial state of the heating, so the temperature change sensed by the infrared sensor 5 becomes large.

Figure 4:
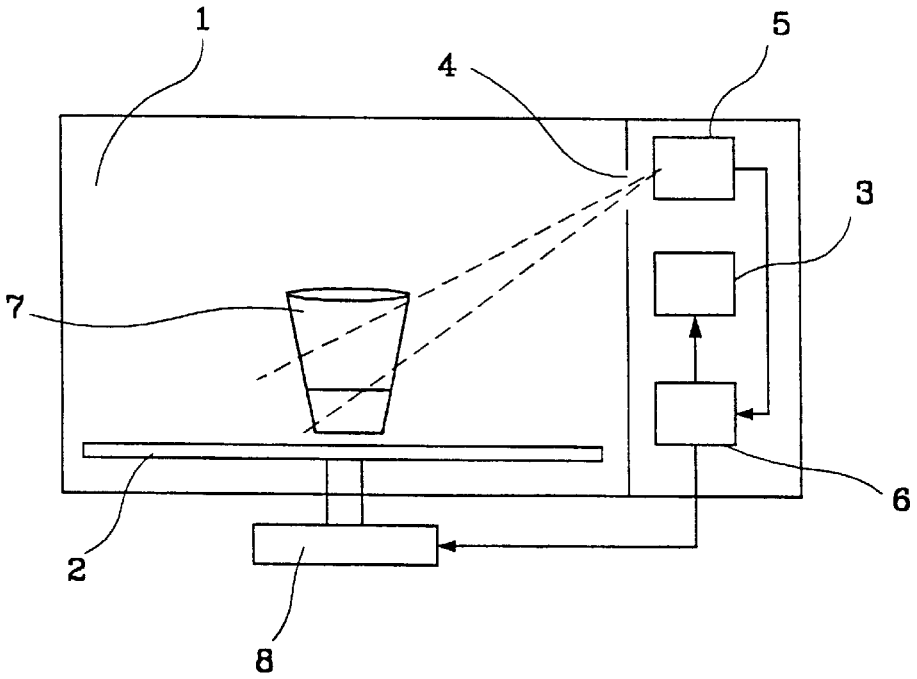
FIG. 4 is a view showing how the temperature of a small quantity of food is sensed by the sensor to the present invention.

If the change of the detected temperature is small during the initial time period, this means that the temperature change is not directly detected by the infrared sensor 5, as shown in FIG. 4. In this case, the heat is conductivity transmitted to the container 7 after the food in the container 7 is heated. Thus, the temperature of the container in the initial heating state is barely different from the temperature before heating. As a result, since the temperature of the container 7 is held at a low temperature during initial time period, the change in the temperature detected by the infrared sensor 5 during the initial time period is small. As described above, when the change in the temperature detected by the infrared sensor 5 during the initial time period is small, the infrared sensor 5 does not directly detect the temperature of the food so that a small quantity of food or the like is judged to be present.

By the above method, the output controlling unit 6E judges the amount of the food or the like in the container 7 and estimates the temperature of the food on the basis of its quantity. Further, the output controlling unit 6E compared the thus estimates temperature with the set cooking temperature to operate in the cooking mode until the estimates temperature is raised to the cooking temperature.

Hereinafter, the operation of the present invention is described in detail relative to FIG. 7.

Figure 7:
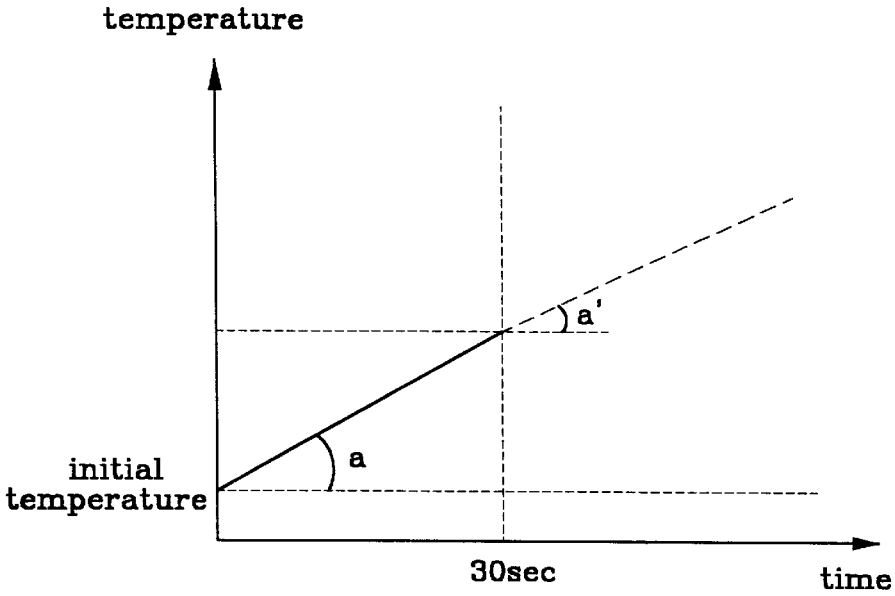
FIG. 7 and FIG. 8 are graphs showing the characteristics of the temperature compensation according to the present invention.
Figure 8:
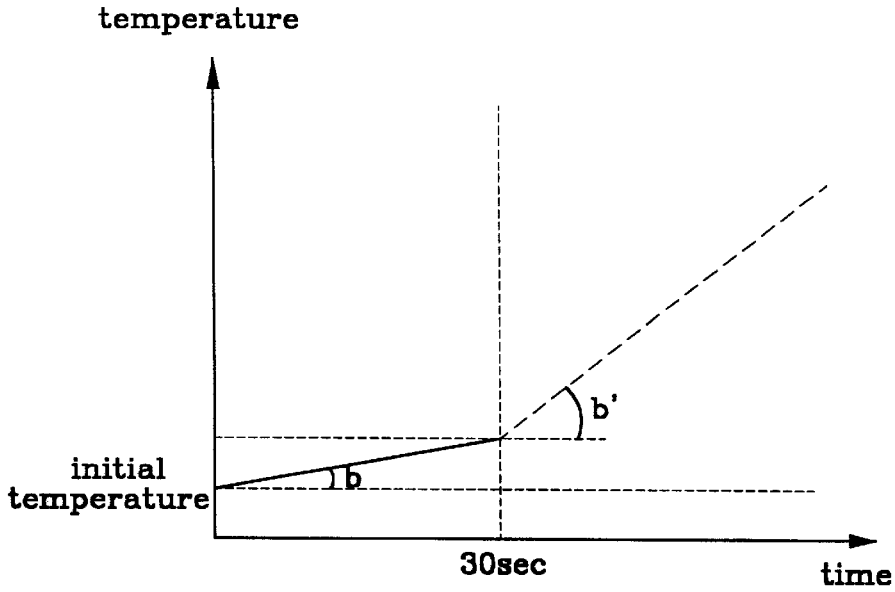

FIGS. 7 and 8 are graphs showing the characteristics of the temperature compensation in the heating method.

First, the user puts a container 7 containing water or milk or food on the turntable 2 and actives the heat starting key of the key input unit 6A. When the heat starting key is activates the turntable driving motor 8.

On the other hand, the cooking temperature is set by the user through the key input unit 6A before activating the heat starting key, and this set cooking temperature is stored in the set temperature storing unit 6B. This means that the cooking temperature is set by the user according to the kind of the food to be cooked. For some food, however, the cooking temperature is previously stored in the set temperature storing unit 6B so that the output controlling unit 6E reads the previously stored cooking temperature to drive the motor 8 and the heating unit 3 accordingly. In other words, the output controlling unit 6E recognizes the current cooking temperature.

Similarly, the cooking time is also set by the user through the key input unit 6A before activating the heat starting key. Further, a previously set cooking time can be recognized by the output controlling unit 6E by selecting an automatic cooking mode.

As described above, the output controlling unit 6E recognizes the cooking temperature and the cooking time when the heating unit 3 starts to oscillate.

When the heating unit 3 is operating, the time counted by the timer 6F is continuously inputted to the output controlling unit 6E so that the output controlling unit 6E judges that, for example, 30 second after start of the heating has elapsed (step 201). In the step 203, the change of the temperature is detected for an initial constant time period (for example, the 30 second). Therefore, it is not necessary for the initial constant time period to be limited to 30 seconds. According to the kind of the food, the initial constant time periods can be long or short corresponding to a long or short total cooking time so as to detect the change of the temperature.

Thus, the output controlling unit 6E detects the temperature gradient process from the start of the heating operation to the expiration of the initial constant time period (about 30 seconds) by step 201. The current temperature detected by the infrared sensor 5 is temporarily stored in the current temperature storing unit 6C. This stored current temperature is repeatedly compared with the previously detected temperature to detect the temperature gradient according to the change of the temperature over the constant time period (step 203).

In the step 203, the temperature gradient is detected differently in the following two cases. The first case is when the change in cooking temperature during the 30 seconds after starting the heating process (i.e., the initial constant time period) is large, as shown in FIG. 7. The second case is that the change in the cooking temperature for the initial constant time period is comparatively small as shown in FIG. 8.

If the temperature gradient during the initial constant time period (about 30 seconds, which should be a multiple of the turntable rotating period to detect correctly the variation degree of the temperature) is steep as shown in FIG. 7, the infrared sensor 5 directly detects the temperature of the food 9 in the container 7 as shown in FIG. 1.

In this case, the container 7 contains a large quantity of food, so that the output controlling unit 6E estimates a temperature which is in proportion to the cooking time and in inverse proportion to the gradient detected in the step 203. After the initial constant time period, the output controlling unit 6E estimates the cooking temperature with the following equation (1).

$$\text{estimating temperature} = a/b(\text{current time} - 30 \text{ seconds}) + c \quad (1)$$

where a is a certain constant.

On the basis of the highest temperature (c) detected over, for example, 30 seconds, the output controlling unit 6E obtains an estimated temperature, which is in inverse proportion to the gradient change of the initial temperature obtained in the step 203 (a/b), and in proportion to the cooking time (current time−30 seconds). At this time, since the estimated temperature is calculated by the lower gradient than the gradient obtained in the step 203, the rate of change of the estimated temperature is small. Thus, the rate of change of the estimated temperature is less steep than the temperature during the initial period shown in FIG. 8 (step 205).

As shown in FIG. 8, when the gradient of the temperature for initial constant time period (about 30 seconds, which should be determined in the multiple of the rotating period to detect correctly the change in temperature) is less steep than the gradient shown in FIG. 7, the infrared sensor 5 cannot directly detect the temperature of the food 9 in the container 7.

In this case, the container 7 contains the small quantity of food, so that the output controlling unit 6E estimates a temperature thereof which is in proportion to the cooking time and in inverse proportion to the detected temperature gradient. In this time, also, the current temperature is estimated with equation 1. The temperature to be estimated rises with a larger gradient than the initially calculated gradient (because of the inverse proportionality between the two). In this case, therefore, the gradient is steeper than the gradient shown in FIG. 7 (step 205).

When the current temperature is estimated in the step 205, the output controlling unit 6E compares the estimated temperature dependent upon the cooking time with the temperature detected by the sensor 5 (step 207).

If the detected temperature is higher than the estimated temperature, the output controlling unit 6E selects the detected temperature as the current temperature (step 213). In the detected temperature is lower than the estimated temperature, the output controlling unit 6E selects the estimated temperature as the current temperature (step 209).

That is, the output controlling unit 6E selects the higher temperature amongst the detected temperature and the estimates temperature as the current temperature. As shown above, since the higher temperature of the two is selected as the current temperature of the food 9 in the container 7, the temperature deviation that is dependent upon the quantity of the food 9 is decreased. Further, the selected current temperature and the set cooking temperature are compared each other (step 211).

Until the selected current temperature is raised to the cooking temperature, the heating unit 3 is driven. When the current temperature reaches the cooking temperature reaches the cooking temperature, the heating unit 3 is stopped by the output controlling unit 6E (step 215).

In the present invention, as described above, it is judged that the cup contains a large quantity of food when the change of the initial temperature is large. Thus, the current estimated temperature rises with a small gradient. In case of a small change of the initial temperature, however, it is judged that the container contains a small quantity of food so that the estimated temperature rises with a large gradient. By comparing the calculated temperature with the set cooking temperature, temperature deviations dependent upon the amount of food in the container can be minimized.

As shown above, the present invention estimates the detected temperature by judging the quantity of the food in the container and this estimated temperature is compared with the set cooking temperature for cooking. Therefore, the cooking temperature may be controlled precisely, so that the user is able to obtain well-cooked food.

What is claimed is:

1. A method of heating material contained in a container with a microwave oven, the method comprising:

applying microwave energy to the material;

detecting a change of a temperature of the material during an initial constant time period;

judging a quantity of the material in the container on the basis of the change of the temperature of the material;

estimating a current temperature of the material in the container on the basis of the quantity of the material judged to be present in the container to obtain an estimated temperature;

comparing the estimated temperature with a directly detected temperature and selecting the higher of the estimated temperature and the directly detected temperature as a current temperature; and continuing to apply microwave energy to the material until the selected current temperature is raised to a preset cooking temperature.

2. The method according to the claim 1, wherein a relatively large quantity of material is judged to be present in the container when a relatively large change in the detected temperature is detected over the initial constant time period is detected and a relatively small quantity of the material is judged to be present when a relatively small variation change in the detected temperature is detected over the initial constant time period.

3. An apparatus for heating a cup using a sensor in a microwave oven, comprising:

first means for determining and storing a temperature gradient dependent upon variation degree of temperature detected by the sensor for initial constant time period;

second means for storing temperature detected by the sensor;

third means for determining and storing an estimated temperature, the estimated temperature being in inverse proportion to the gradient stored in the gradient storing means and in proportion to the current time; and means for comparing temperature stored in the second and third means to heat the cup in the microwave oven at the higher temperature.

4. A method for heating material in a container to a preset temperature, the method comprising:

applying energy to the material so as to heat the material;

measuring a change in a temperature of the material for a time period;

judging an amount of the material in the container based on a rate of change of the temperature during the time period;

estimating the temperature of the material based on the amount of the material judged to be in the container;

detecting a temperature of either the material in the container or of the container, using a temperature sensor;

comparing the estimated temperature of the material and the detected temperature of either the material in the container or of the container and selecting the higher temperature as a current temperature of the material; and continuing to apply the energy to the food until the current temperature of the food is at least as high as the preset temperature.

5. The method according to claim 4, wherein a relatively high rate of change of temperature is judged to correspond with a relatively large quantity of material, and wherein a relatively small rate of change of temperature is judged to correspond with a relatively small quantity of material.

6. An apparatus for controlling a process of heating a material in a container to a preset temperature, comprising:

a temperature sensor for obtaining a detected temperature of the material or the container;

means for obtaining a temperature gradient corresponding to a change in the detected temperature of the material during the heating process during a time period;

means for judging an amount of the material in the container based on the temperature gradient;

means for estimating a temperature of the material, the estimated temperature of the material being in inverse proportion to the temperature gradient and in proportion to a current elapsed time;

means for comparing the estimated temperature and the detected temperature and selecting the higher of the two temperatures as a current temperature of the material; and means for controlling the application of energy to the material until the current temperature of the material is at least as high as the preset temperature.

* * * * *